US007188820B2

(12) United States Patent
Kobayashi et al.

(10) Patent No.: US 7,188,820 B2
(45) Date of Patent: Mar. 13, 2007

(54) VIBRATION DAMPING FLOOR STRUCTURE

(75) Inventors: Atsuhiko Kobayashi, Kumagaya (JP); Hironori Ooshima, Kumagaya (JP); Hajime Sugimoto, Tokyo (JP)

(73) Assignee: Hitachi Kizai, Inc., Tokyo (JP)

( * ) Notice: Subject to any disclaimer, the term of this patent is extended or adjusted under 35 U.S.C. 154(b) by 0 days.

(21) Appl. No.: 10/900,526

(22) Filed: Jul. 28, 2004

(65) Prior Publication Data

US 2005/0045796 A1 Mar. 3, 2005

(30) Foreign Application Priority Data

Jul. 31, 2003 (JP) ..... 2003-204788

(51) Int. Cl.
*F16M 13/00* (2006.01)
*E04B 1/98* (2006.01)

(52) U.S. Cl. ..... 248/636; 248/580; 52/167.5

(58) Field of Classification Search ..... 248/636, 248/618, 580, 581; 52/167.5, 167.6
See application file for complete search history.

(56) References Cited

U.S. PATENT DOCUMENTS 2,014,643 A * 9/1935 Bakker ..... 384/49
2,680,259 A * 6/1954 Milk ..... 14/73.5
4,060,252 A * 11/1977 Mowery ..... 280/79.11
4,402,108 A * 9/1983 Pannwitz ..... 16/26
4,662,133 A * 5/1987 Kondo ..... 52/167.6
4,883,250 A * 11/1989 Yano et al. ..... 248/638
4,974,378 A * 12/1990 Shustov ..... 52/167.5
5,419,639 A * 5/1995 Hobbs et al. ..... 384/18
5,689,919 A * 11/1997 Yano ..... 52/167.6
5,979,127 A * 11/1999 Yoneda ..... 52/167.5
6,123,313 A * 9/2000 Otsuka et al. ..... 248/580
6,505,806 B1 * 1/2003 Glaesener ..... 248/638

FOREIGN PATENT DOCUMENTS

JP 10317658 A * 12/1998
JP 11294525 A * 10/1999

* cited by examiner

*Primary Examiner*—Anita M. King
(74) *Attorney, Agent, or Firm*—Muramatsu & Associates

(57) ABSTRACT

A vibration damping floor structure for reducing vibrations and shocks applied to a building. The vibration damping floor structure includes a frame structure formed by connecting a plurality of frames, a plurality of ball bearing supports formed on predetermined locations of the frame structure, and a plurality of ball bearings formed on each ball bearing support. Each bearing support is structured so that all of the ball bearings can contact the floor by adjusting the height and following the inclination of the floor.

9 Claims, 6 Drawing Sheets

VIBRATION DAMPING FLOOR STRUCTURE

FIELD OF THE INVENTION

The present invention relates to a vibration damping floor, and more particularly to a structure of a vibration damping floor for constructing a floor such as a free access floor on a concrete floor of a building.

BACKGROUND OF THE INVENTION

An example of vibration damping floor structure is shown in Japanese Patent Laid-open publication No. 10-317658. The vibration damping floor structure disclosed by this publication employs square cylindrical pipes or C-type steel frames having smaller cross sectional size and thickness than that of H-type steel frames. Ball bearings are installed in the square cylindrical pipes or C-type steel frames at predetermined locations. Thus, the example of this vibration damping floor structure achieves low cost, low floor height, low weight, and a short construction time.

In such a conventional vibration damping floor structure, a plurality of ball bearing supports are formed on the frame structure, and only one ball bearing is installed on each ball bearing support. Therefore, there is a problem in that a bearing force is insufficient for a large load. In the case where two or more ball bearings are installed on each ball bearing support, it is preferable that all of the ball bearings contact the surface of the concrete floor of the building. However, because there are inclinations or irregularities on the concrete floor surface, there is a problem that it is usually not possible for all of the ball bearings contact the floor surface.

SUMMARY OF THE INVENTION

Therefore, in view of the above mentioned problems, it is an object of the present invention to provide a vibration damping floor structure which is low cost, low floor height, low weight, and short construction time as well as capable of achieving a high bearing force for a large load.

It is another object of the present invention to provide a vibration damping floor structure in which two or more ball bearings are installed in each ball bering support and all of the ball bearings can contact the floor surface.

It is a further object of the present invention to provide a vibration damping floor structure which is capable of adjusting the height and angle of the ball bearings so that the ball bearings can always contact the concrete surface of the building to achieve a high bearing force.

In order to solve the above problems, the vibration damping floor of the present invention for reducing vibrations and shocks applied to a building is comprised of a frame structure formed by connecting a plurality of frames, a plurality of ball bearing supports formed on predetermined locations of the frame structure, and a plurality of ball bearings formed on each ball bearing support. Each of the bearing support includes means for following an inclination of a floor surface of the building and means for adjusting height, thereby contacting all of the ball bearings with the floor surface of the building.

Each of the frames is a C-type steel frame and the ball bearing support is formed inside of the frame. Each ball bearing support is formed with a first support member fixedly connected to the frame, a second support member rotatably connected to the first support member, a third support member mounting a ball bearing rotatably connected to the first support member. The first support member, the second support member, and the third support member are connected with one another through a shaft pin. The second support member and the third support member having the ball bearing rotate in response to an inclination of the floor surface, thereby establishing the means for following the inclination.

The first support member, the second support member, and the third support member are connected with one another through a shaft pin. The first support member has long holes for the shaft pins so that the shaft pin can move in the long holes. The first support member has a screw which presses the second support member when rotated, thereby establishing the means for adjusting the height of the ball bearing support.

In another aspect, each ball bearing support is formed with a first support member fixedly connected to the frame, a ball joint rotatably connected to the first support member at one end, and three or more ball bearings are mounted on another end of the ball joint.

According to the present invention, the vibration damping floor structure of low cost, low floor height, low weight, and short construction time as well as high bearing force can be achieved. In the vibration damping floor structure, two or more ball bearings are installed in each ball bearing support. The vibration damping floor structure is capable of adjusting the height and angle of the ball bearings so that all of the ball bearings can always contact the concrete surface of the building, thereby achieving the high bearing force.

DETAILED DESCRIPTION OF THE INVENTION

Figure 7:
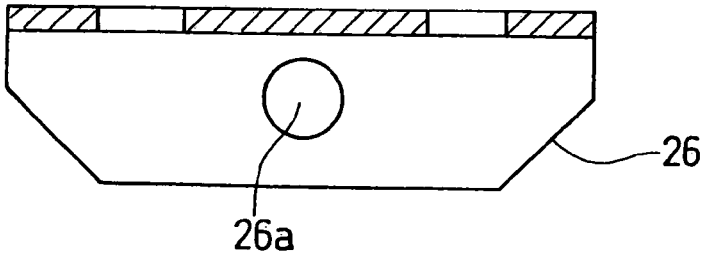
FIG. 7 is a cross sectional view showing an example of structure of the third support member shown in FIG. 3 taken along the center thereof.
Figure 8:
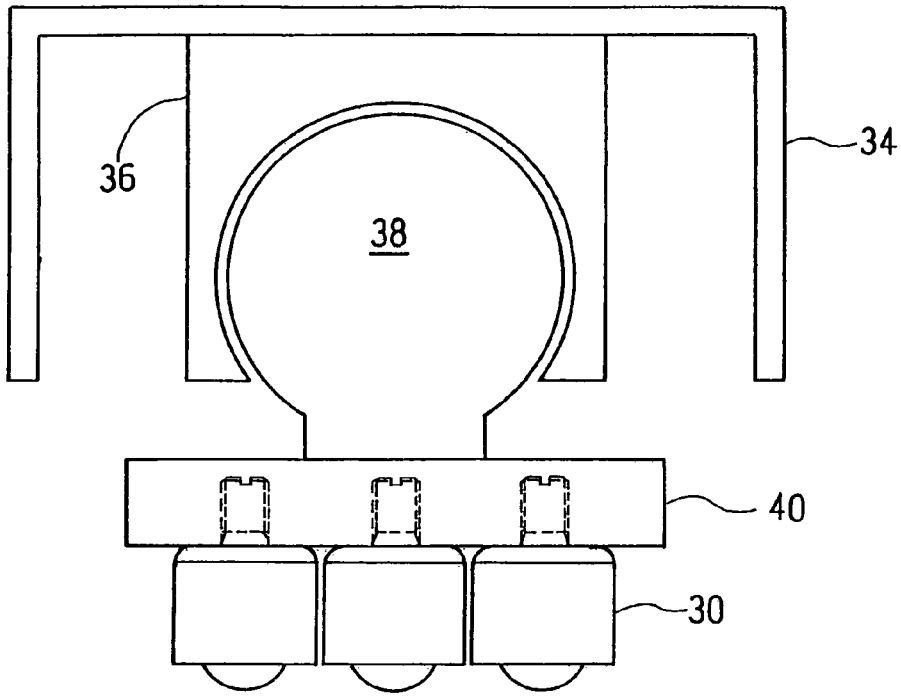
FIG. 8 is a cross sectional view showing an example of structure of the ball bearing support incorporating a ball joint in accordance with the vibration damping floor structure of the present invention.
Figure 9:
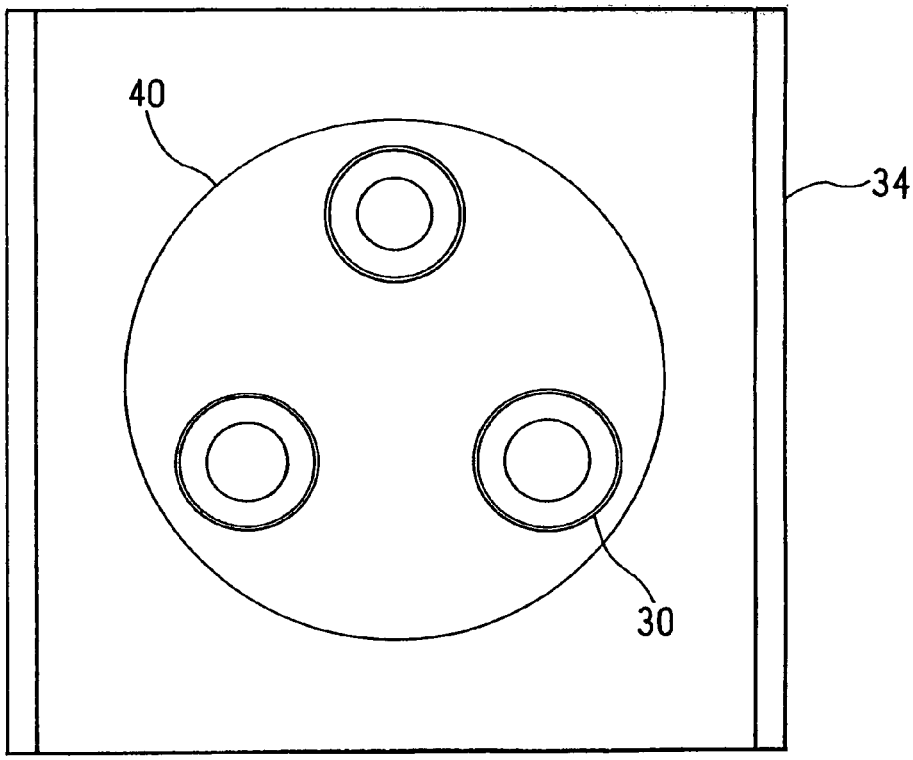
FIG. 9 is a bottom view showing an example of structure of the ball bearing support incorporating the ball joint of FIG. 8 in accordance with the vibration damping floor structure of the present invention.

With reference to the accompanying drawings, the embodiments of the present invention will be explained in detail below. FIGS. 1–7 show examples of structure in the embodiment of the vibration damping floor of the present invention, and FIGS. 8 and 9 show an example of ball joint preferable to another embodiment of the present invention. The vibration damping floor structure of the present invention is used, for example, on a concrete floor of a building for forming a free access floor thereon.

Figure 1:
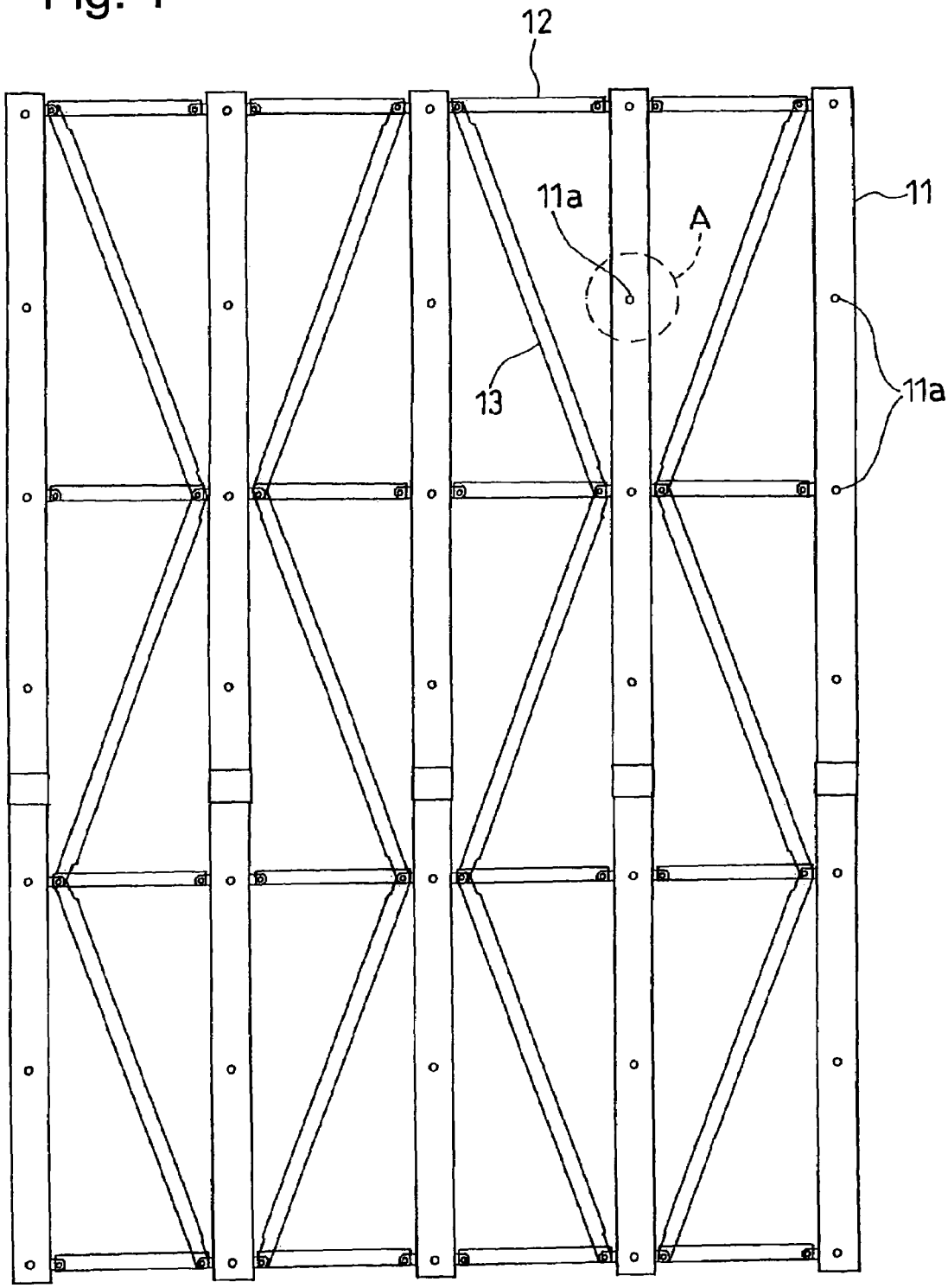
FIG. 1 is a plan view showing an example of frame structure assembled by connecting coupling ribs and braces to frames for establishing the vibration damping floor structure of the present invention.
Figure 2:
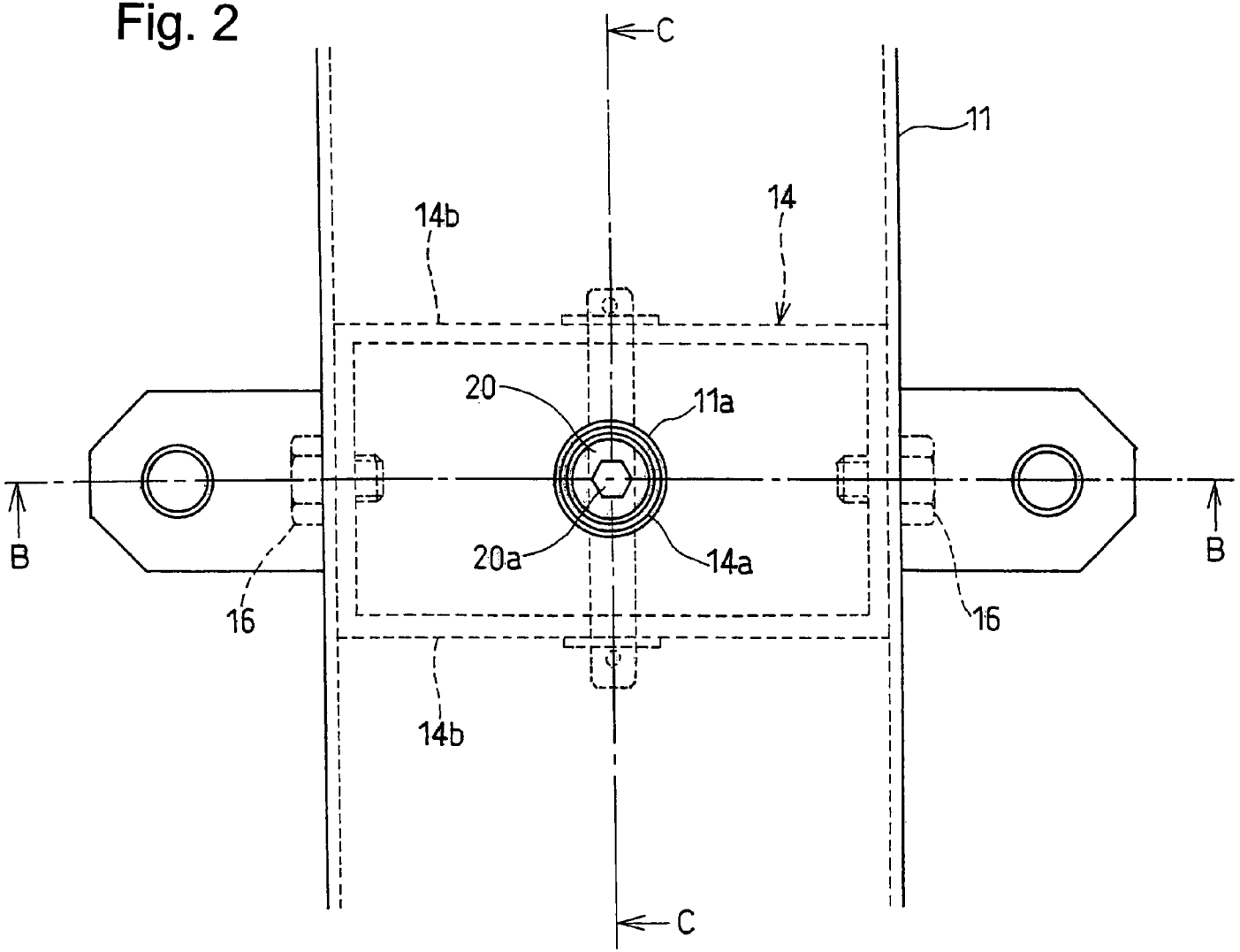
FIG. 2 is an enlarged plan view of the frame structure showing the part A of FIG. 1 implementing the vibration damping floor structure of the present invention.

FIG. 1 is a plan view showing an example of frame structure of the vibration damping floor on which support members (not shown) for supporting the panels of a free access floor will be built. FIG. 2 is an enlarged plan view of the frame structure showing the part A of FIG. 1 in the vibration damping floor structure of the present invention. The frame structure includes frames 11 connected by coupling ribs 12 and braces 13 for establishing the vibration damping floor structure of the present invention.

Figure 3:
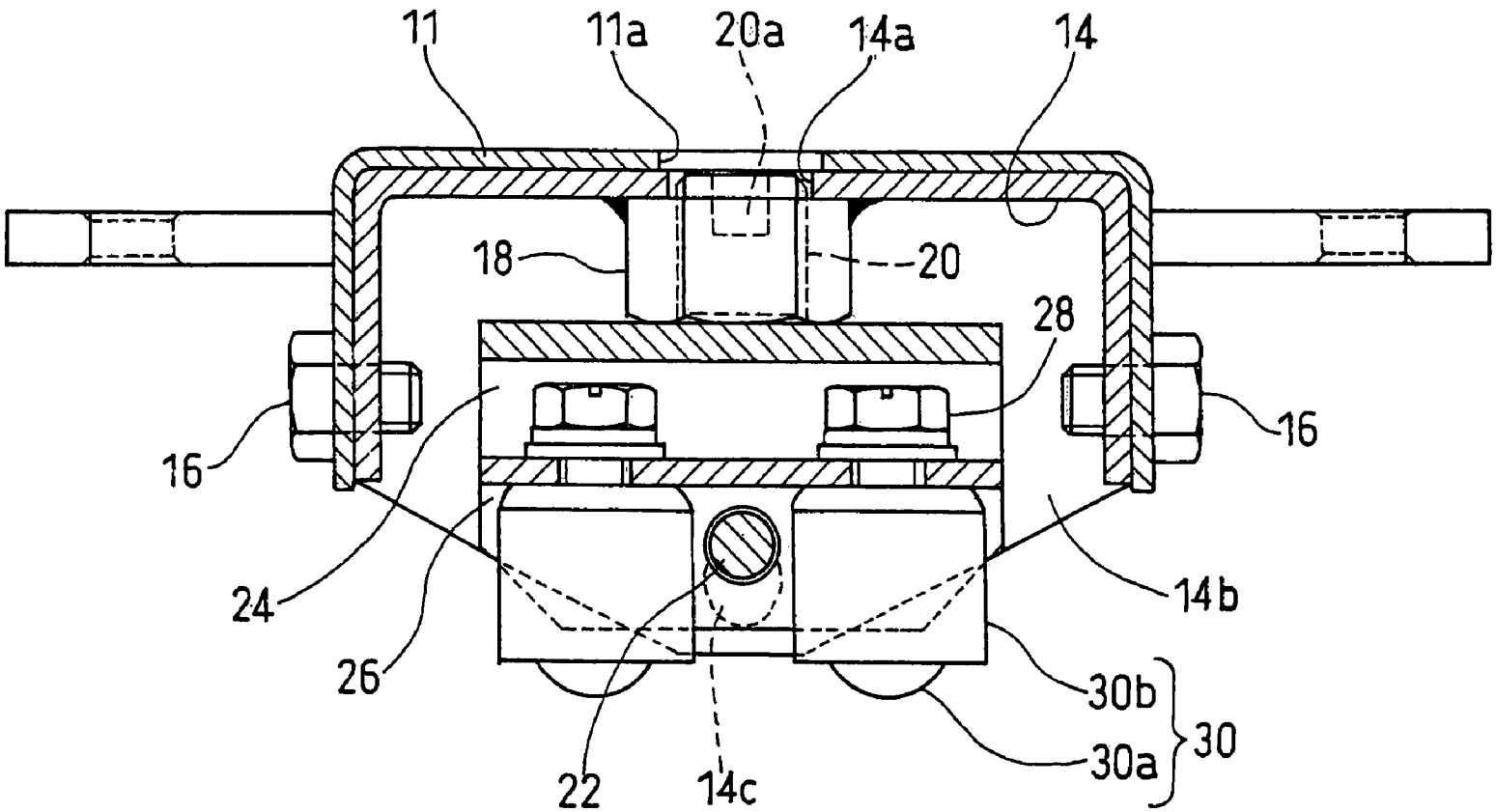
FIG. 3 is a cross sectional view showing an example of structure of the vibration damping floor structure of the present invention taken along the B—B line of FIG. 2.

FIG. 3 shows a cross sectional structure of the vibration damping floor structure taken along the B—B line of FIG. 2. As shown in FIG. 3, the frame 11 is configured by a C-type steel frame having a C-shape in cross section. At each of the predetermined locations of the frame 11, such as the point A of FIG. 1, a ball bearing support is formed inside of the frame 11. The ball bearing support is formed by a first support member 14 having a C-shaped cross section which fitted in the C-shaped frame 11 through a pair of bolts 16. An example of structure of the ball bearing will be described later.

Each ball bearing support is preferably formed on each corner of the frame structure, each end of the frame 11, and intermediate positions such as the point A of the frame 11. When a free access floor is constructed on the frame structure of FIG. 1, the ball bearing supports are preferably formed on the same locations where support members of the free access floor will be constructed.

As shown in FIGS. 1 and 3, at the locations where the ball bearing supports will be installed, there are round holes 11*a* on the frames 11. At each ball bearing support, a nut 18 is fixedly formed at the inside of the first support member 14 coaxially with a round hole 14*a*. For example, the nut 18 is bonded to the first support member 14 through welding as shown in FIG. 3.

Further, on a female screw of the fixed nut 18, a male screw 20 is inserted as shown in FIG. 3. The male screw 20 has a hexagon hole 20*a* at the top. Thus, by rotating the male screw 20 with use of a hexagon wrench, for example, at the hexagon hole 20*a*, the male screw 20 moves in an axial direction of the fixed nut 18 (up and down direction of FIG. 3).

Instead of the hexagon hole 20*a*, other forms of opening such as a minus or plus shaped opening for a screw driver can be used. Preferably, a locking mechanism for eliminating backlash on the fixed nut 18 will be incorporated, thereby preventing the male screw 20 from loosening and moving up and down.

Figure 4:
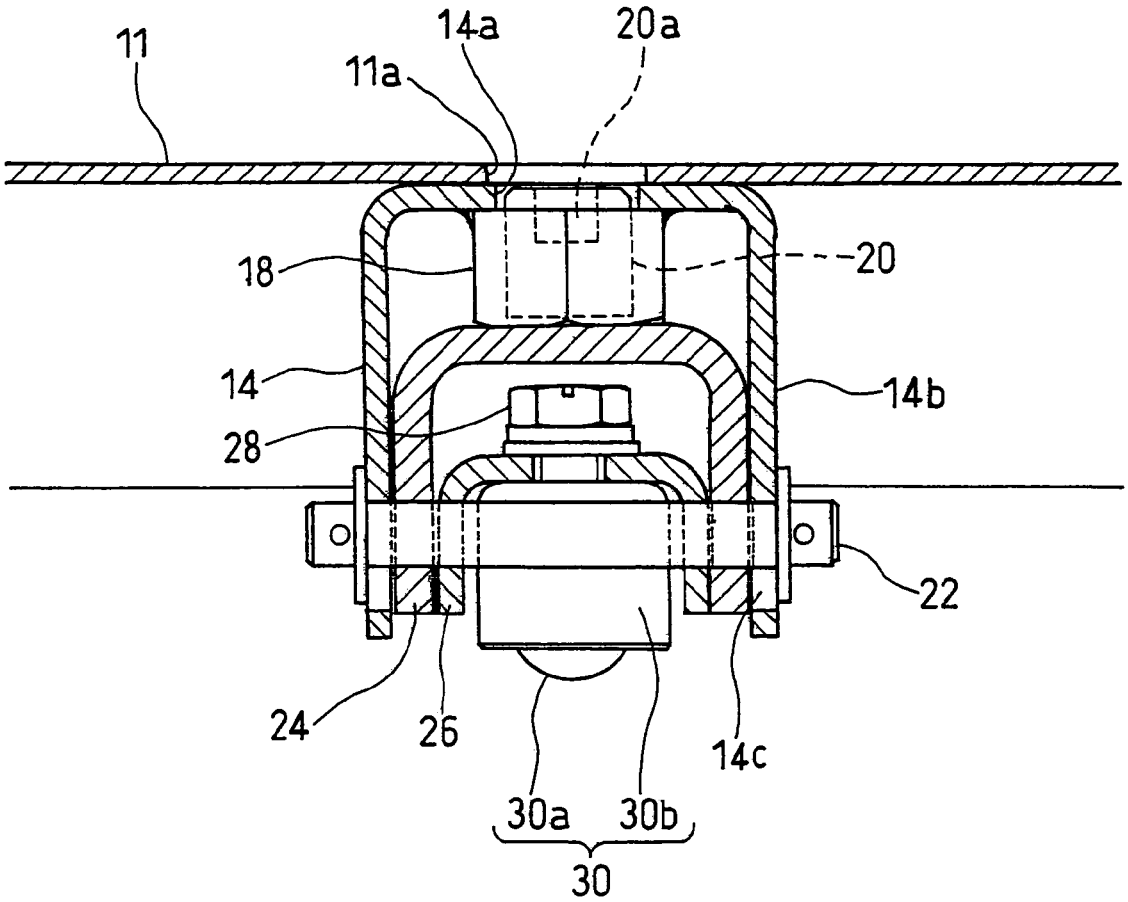
FIG. 4 is a cross sectional view showing an example of structure of the vibration damping floor structure of the present invention taken along the C—C line of FIG. 2.
Figure 5:
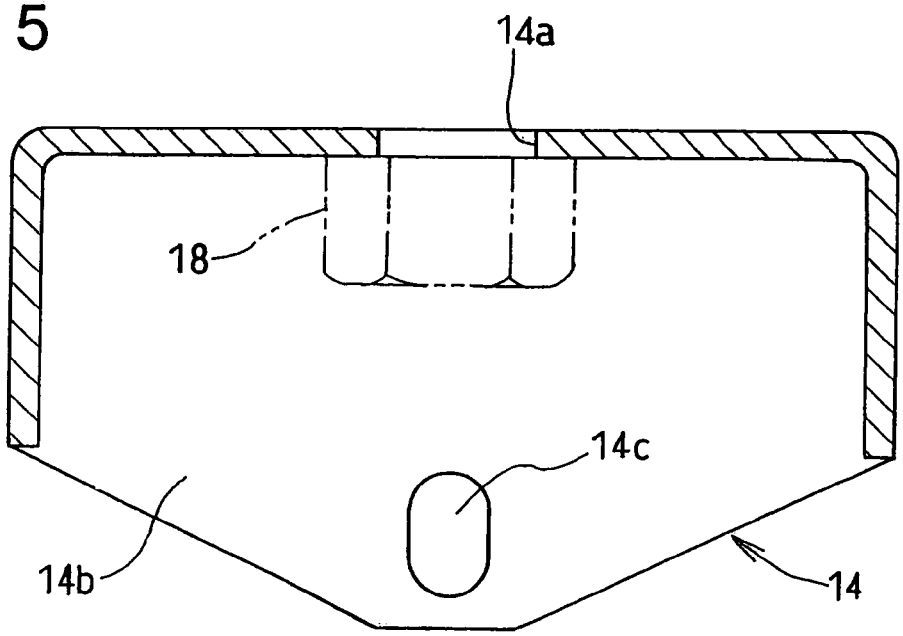
FIG. 5 is a cross sectional view showing an example of structure of the first support member shown in FIG. 3 taken along the center thereof.

As shown in FIG. 2, the first support member 14 has a pair of bearing plates 14*b* parallel with one another in a transversal direction (horizontal direction of FIG. 2) of the frame 11. An example of cross sectional shape of the first support member 14 with the bearing plate 14*b* is shown in FIG. 5. FIG. 4 is a cross sectional view showing the structure of the vibration damping floor structure taking along the C—C line of FIG. 2. As shown in FIGS. 4 and 5, on the pair of bearing plates 14*b*, at the lower end thereof, long holes 14*c* are created. At the pair of long holes 14*c* on the bearing plates 14, a shaft pin (shaft member) 22 is inserted at both ends.

The ball bearing support further includes a second support member (pair of bearing plates) 24 and a third support member (pair of bearing plates) 26. As shown in FIG. 4, the second support member 24 is installed inside of the first support member 14, and the third support member 26 is installed inside of the second support member 24. An example of cross sectional shape of the second support member 24 is shown in FIG. 6, and an example of cross sectional shape of the second support member 26 is shown in FIG. 7.

Figure 6:
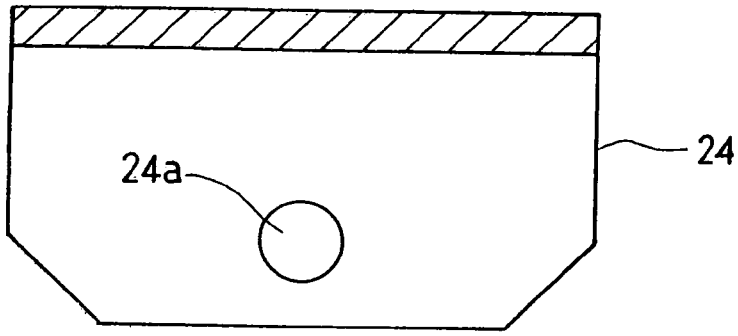
FIG. 6 is a cross sectional view showing an example of structure of the second support member shown in FIG. 3 taken along the center thereof.

As shown in FIGS. 4 and 6, on the pair of bearing plates of the second support member 24, round holes 24*a* are created. As shown in FIGS. 4 and 7, on the pair of bearing plates of the third support member 26, round holes 26*a* are created. The shaft pin 22 is inserted in the first, second and third support member 14, 24, 26 through the long holes 14*c*, round holes 24*a*, and round holes 26*a*, respectively, as shown in FIG. 4.

As shown in FIG. 3, at the bottom of the third support member 26, a pair of ball bearings 30 are attached symmetrically relative to the shaft pin 22. More precisely, a holder 30*b* for rotatably holding a rolling ball 30*a* of each ball bearing 30 is fixed to the third support member 26 through a nut 28 and a male screw. Since the third support member 26 is rotatable about the shaft pin 22, the two ball bearings 30 also rotate in combination with the third support member 26.

Since the ball bearing support has the structure as described above, it is possible to balance with or follow an inclination of the floor of the building because the third support member 26 rotates to match the inclination of the floor. Accordingly, it is possible that the two rolling balls 30*a* of the ball bearings 30 contact with the floor surface of the building.

Further, as shown in FIGS. 3 and 4, because of the long holes 14*c* formed on the first support member 14, the second support member 24 and the third support member 26 can move in the up and down direction with the shaft pin 22. Namely, by rotating the male screw 20 which presses the top surface of the second support member, the second support member 24 can move up and down depending on the position of the male screw 20. As a result, the ball bearings 30 attached to the third support member 26 can also move up and down.

Since the ball bearing support has the structure as described above, it is possible to adjust the height of the ball bearings 30 when the floor of the building has irregularity on its surface. Accordingly, it is possible that the two rolling balls 30*a* of the ball bearings 30 contact with the floor surface of the building. Consequently, the vibration damping floor structure of the present invention can achieve a high bearing force.

In the foregoing example, two ball bearings 30 are used at each ball bearing support on the frame 11. However, the present invention can be implemented for the case where three or more ball bearings are formed at each ball bearing support. In such a case, instead of using the shaft pin 22 of the foregoing embodiment, ball joints can be used as shown in FIGS. 8 and 9. Consequently, three or more ball bearings can contact with the building floor regardless of the condition of the floor.

An example of structure of the ball bearing support incorporating a ball joint is shown in the cross sectional view of FIG. 8. A bottom view of the ball bearing support of FIG.

8 is shown in FIG. 9. In the ball joint shown in FIG. 8, a first support member 34 is attached to the frame 11 (FIGS. 1 and 2). A holder 36 is attached to the inside of the first support member 34. A ball 38 is connected to the holder 36 in a manner rotatable to any directions.

The lower end of the ball 38 is connected to a second support member 40 having a disc shape as shown in the bottom view of FIG. 9. On the lower surface of the second support member 40, three ball bearings 30 are formed at triangular locations. Under this arrangement, since the ball joint formed with the first support member 40, holder 36, and the ball 38 is incorporated, the three bearings 30 can change the angle depending on the inclination of the concrete surface of the building. Thus, all the ball bearings contact with the surface of the concrete floor of the building even if the floor is inclined, which increases the bearing force of the ball bearing support.

In the foregoing example, two ball bearings 30 are mounted on the first support member 14 in the transversal direction of the frame 11. It is also possible that the two ball bearings 30 are aligned in the longitudinal direction of the frame 11.

The foregoing explanation has been made for the case where the free access floor is formed on the frame structure, however, the present invention can be implemented for other types of floor as well.

The vibration damping floor structure of the present invention reduces the vibration and shocks applied to the building by rolling actions of the ball bearings on the floor of the building. Therefore, it is preferable that a steel plate is laid on the concrete floor of the building to promote the rolling actions of the ball bearings.

In the foregoing, the embodiments using either the two ball bearings or the three bearings have been described. It is also possible that different numbers of ball bearings are used depending on locations of the ball bearing supports. For example, a particular ball bearing support may have only one ball bearing while another bearing support may have two bearings, and other bearing supports may have three or more ball bearings, etc.

As has been described above, according to the present invention, the vibration damping floor structure of low cost, low floor height, low weight, and short construction time as well as high bearing force can be achieved. In the vibration damping floor structure, two or more ball bearings are installed in each ball bearing support. The vibration damping floor structure is capable of adjusting the height and angle of the ball bearings so that all of the ball bearings can always contact the concrete surface of the building, thereby achieving the high bearing force.

Although the invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A vibration damping floor structure in which a frame structure having a plurality of ball bearing supports moves on a surface of a floor through ball bearings to reduce the vibration, comprising:

a plurality of ball bearings formed on each ball bearing support;

wherein each of the bearing support includes means for following an inclination of the floor and means for adjusting height, thereby allowing all of the ball bearings to contact the floor while accommodating uneven contours of the floor.

2. A vibration damping floor structure as defined in claim 1, wherein in which a free access floor is constructed on the frame structure.

3. A vibration damping floor structure for reducing vibrations and shocks applied to a building, comprising:

a frame structure formed by connecting a plurality of frames;

a plurality of ball bearing supports formed on predetermined locations of the frame structure; and a plurality of ball bearings formed on each ball bearing support;

wherein each of the bearing support includes means for following an inclination of a floor surface of the building and means for adjusting height, thereby allowing all of the ball bearings to contact the floor while accommodating uneven contours of the floor.

4. A vibration damping floor structure as defined in claim 3, wherein each of the frames is a C-type steel frame and the ball bearing support is formed inside of the frame.

5. A vibration damping floor structure as defined in claim 4, wherein each ball bearing support is formed with a first support member fixedly connected to the frame, a second support member rotatably connected to the first support member, a third support member mounting a ball bearing rotatably connected to the first support member.

6. A vibration damping floor structure as defined in claim 5, wherein the first support member, the second support member, and the third support member are connected with one another through a shaft pin, wherein the second support member and the third support member having the ball bearing rotate in response to an inclination of the floor surface, thereby establishing the means for following the inclination.

7. A vibration damping floor structure as defined in claim 5, wherein the first support member has a screw which presses the second support member when rotated, thereby establishing the means for adjusting the height of the ball bearing support.

8. A vibration damping floor structure as defined in claim 5, wherein the first support member, the second support member, and the third support member are connected with one another through a shaft pin, wherein the first support member has long holes for the shaft pin so that the shaft pin can move in the long holes, and wherein the first support member has a screw which presses the second support member when rotated, thereby establishing the means for adjusting the height of the ball bearing support.

9. A vibration damping floor structure as defined in claim 4, wherein each ball bearing support is formed with a first support member fixedly connected to the frame, a ball joint rotatably connected to the first support member at one end, wherein three or more ball bearings are mounted on another end of the ball joint.

* * * * *